US006938327B2

(12) United States Patent
Takayama et al.

(10) Patent No.: US 6,938,327 B2
(45) Date of Patent: Sep. 6, 2005

(54) METHOD OF MANUFACTURING A COMMON MODE CHOKE COIL

(75) Inventors: Manabu Takayama, Gunma-ken (JP); Kouji Taketomi, Gunma-ken (JP); Tetsuo Kumahora, Gunma-ken (JP)

(73) Assignee: Taiyo Yuden Co., Ltd., Tokyo (JP)

( * ) Notice: Subject to any disclaimer, the term of this patent is extended or adjusted under 35 U.S.C. 154(b) by 75 days.

(21) Appl. No.: 10/405,246

(22) Filed: Apr. 3, 2003

(65) Prior Publication Data

US 2003/0163914 A1 Sep. 4, 2003

Related U.S. Application Data

(62) Division of application No. 09/537,386, filed on Mar. 29, 2000, now abandoned.

(30) Foreign Application Priority Data

Mar. 30, 1999 (JP) ..... 1999-88462

(51) Int. Cl.[7] ..... H01F 7/06

(52) U.S. Cl. ..... 29/605; 29/606; 29/608; 264/250; 264/272; 336/83; 336/175; 336/192; 336/200; 336/212; 336/233; 427/116

(58) Field of Search ..... 29/605, 606, 608; 264/250, 272; 336/83, 175, 192, 200, 212, 233; 427/116

(56) References Cited

U.S. PATENT DOCUMENTS

| | | | | |
|---|---|---|---|---|
| 4,549,042 A | | 10/1985 | Akiba | 174/114 |
| 4,696,100 A | | 9/1987 | Yamamoto et al. | 29/605 |
| 5,359,311 A | | 10/1994 | Kawabata | 336/83 |
| 5,544,410 A | | 8/1996 | Kato | 29/605 |
| 5,692,290 A | | 12/1997 | Mamada | 29/605 |
| 5,821,843 A | * | 10/1998 | Mamada et al. | 336/83 |
| 6,076,253 A | | 6/2000 | Takayama | 29/605 |
| 6,189,202 B1 | | 2/2001 | Masuda et al. | 29/605 |
| 6,343,413 B1 | | 2/2002 | Masuda et al. | 29/605 |
| 6,377,151 B1 | * | 4/2002 | Takayama et al. | 336/83 |

FOREIGN PATENT DOCUMENTS

| | | | | |
|---|---|---|---|---|
| JP | 3-126033 | | 12/1991 | |
| JP | 08306570 A | * | 11/1996 | H01F/41/10 |
| JP | 10106841 A | * | 4/1998 | H01F/17/06 |
| JP | 08-083716 | | 3/1999 | |

OTHER PUBLICATIONS

"Reducing radiated emissions on high speed signal lines using common mode using choke coils"; F.J.; Electromagnetic Compatibility, 1995. Symposium Record. 1995 IEEE International Symposium on, Aug. 14–18, 1995; pp. 435–439.*

* cited by examiner

*Primary Examiner*—Paul D Kim
(74) *Attorney, Agent, or Firm*—Arent Fox, PLLC

(57) ABSTRACT

A common mode choke coil has a plurality of metallic conducting wires buried into a sintered magnetic material such that the metallic conducting wires are proximate to each other and an electrode mounted on a surface of the sintered magnetic material so as to be connected to each end portion of each of the metallic conducting wires. The metallic conducting wires are integrally coated with a non-magnetic and electrically insulating material at a predetermined distance between each of the metallic conducting wires to thereby form coated conducting wires. The coated conducting wires buried into the sintered magnetic material are thus obtained.

1 Claim, 3 Drawing Sheets

METHOD OF MANUFACTURING A COMMON MODE CHOKE COIL

This is a division of application Ser. No. 09/537,386 filed Mar. 29, 2000, now abandoned.

BACKGROUND OF THE INVENTION

1. Field of the Invention

The present invention relates to a common mode choke coil for removing common mode noises which are superimposed in a power supply line, a signal line or the like of an electronic equipment. The present invention also relates to a method of manufacturing the common mode choke coil.

2. Description of the Related Art

The following common mode choke coil and a method of manufacturing the same are known from Japanese Published Unexamined Patent Application No. 304035/1993. Namely, inside a resin which is mixed with powder of a magnetic material, two metallic coils which have the same number of winding and the same winding direction are buried substantially in parallel to each other in a substantially coaxial manner, whereby a formed body made of a resin mixed with powder of magnetic material is obtained. An electrode which is electrically connected to a corresponding end portion of each of the metallic coils is thereafter formed.

In the above-described conventional common mode choke coil, two metallic coils are separately or independently formed and are buried into the resin which has mixed therein powder of the magnetic material. In the process of manufacturing it, the two metallic coils shall not come into contact with each other. Therefore, the powder of the magnetic material will inevitably have to be interposed between the two metallic coils. As a result, an independent magnetic path for each of the metallic coils will be formed through the magnetic material interposed between both the coils. An independent magnetic path thus formed for each of the coils will generate an impedance not only to the common mode noises but also to the normal mode noises. As a consequence, if the common mode choke coil is connected to a signal line, the impedance works as a load to the signal, resulting in an abnormality in the signal wave form.

On the other hand, if two electrically insulating coated conducting wires are wound around a core which is made up of a bar-shaped or drum-shaped magnetic material, it is possible to prevent the magnetic material from being interposed between both the conducting wires. However, this arrangement is not preferable as a common mode choke coil because the frequency characteristics become high in Q value if the conducting wires are not covered on their outside with a sintered magnetic material.

In view of the above-described problems associated with the conventional common mode choke coil and a method of manufacturing the same, the present invention has an object of providing a common mode choke coil whose Q value is not high and whose impedance to the normal mode noises is low, as well as providing a method of manufacturing the same.

SUMMARY OF THE INVENTION

In order to attain the above and other objects, the present invention is a common mode choke coil comprising: a plurality of metallic conducting wires buried into a sintered magnetic material such that the metallic conducting wires are proximate to each other; an electrode mounted on a surface of the sintered magnetic material so as to be connected to each end portion of each of the metallic conducting wires; wherein the metallic conducting wires are integrally coated with a non-magnetic and electrically insulating material while keeping a predetermined distance between each of the metallic conducting wires to thereby form coated conducting wires buried into the sintered magnetic material.

The coated conducting wires may be buried into the sintered magnetic material in a straight shape, but they may also be buried into the sintered magnetic material in a state of being spirally wound depending on the required impedance. In this case, if the distance between the metallic conducting wires is wide apart, capacitance or stray occurs between the metallic conducting wires, with the result that the impedance to the normal mode noises at a high-frequency band becomes large. Therefore, it is desirable to set the distance between the metallic conducting wires to ⅕ or less of a winding pitch of the coated conducting wires.

According to another aspect of the present invention, there is provided a method of manufacturing a common mode choke coil comprising the steps of: a) kneading powder of a magnetic material and a binder together; b) burying coated conducting wires into a semimanufactured product obtained in step a), the coated conducting wires each having a length equivalent to at least several common mode choke coils and being integrally coated with a non-magnetic and electrically insulating material in a state in which a plurality of metallic conducting wires are spaced apart with a predetermined distance therebetween; c) dividing a semimanufactured product obtained in step b) into pieces, each piece having a length equivalent to one common mode choke coil; d) exposing both end portions of each of the metallic conducting wires which constitute said coated conducting wires; e) sintering a semimanufactured product obtained in step d); and thereafter f) connecting an electrode to each of the end portions of each of the metallic conducting wires.

Alternatively, there may also be employed a method comprising the steps of: a) kneading powder of a magnetic material and a binder together; b) burying coated conducting wires into a semimanufactured product obtained in step a), the coated conducting wires each having a length equivalent to at least several common mode choke coils and being integrally coated with a non-magnetic and electrically insulating material in a state in which a plurality of metallic conducting wires are spaced apart with a predetermined distance therebetween; c) dividing a semimanufactured product obtained in step b) into pieces, each piece having a length equivalent to one common mode choke coil; d) exposing both end portions of each of the metallic conducting wires which constitute the coated conducting wire; e) connecting an electrode to each of the end portions of each of the metallic conducting wires; and thereafter f) sintering a semimanufactured product obtained in step e).

Still alternatively, there may still be employed a method comprising the steps of: a) kneading powder of a magnetic material and a binder together; b) burying a coated conducting wire into a semimanufactured product obtained in step a), the coated conducting wires each having a length equivalent to at least several common mode choke coils and being integrally coated with a non-magnetic and electrically insulating material in a state in which a plurality of metallic conducting wires are spaced apart with a predetermined distance therebetween; c) sintering a semimanufactured product obtained in step b); d) dividing a semimanufactured product obtained in step c) into pieces, each piece having a length equivalent to one common mode choke coil; e) exposing both end portions of each of the metallic conducting wires which constitute the coated conducting wires; and thereafter f) connecting an electrode to each of the end portions of each of the metallic conducting wires.

BRIEF DESCRIPTION OF THE DRAWINGS

The above and other objects and the attendant advantages of the present invention will become readily apparent by reference to the following detailed description when considered in conjunction with the accompanying drawings wherein.

DETAILED DESCRIPTION OF A PREFERRED EMBODIMENT

Figure 1:
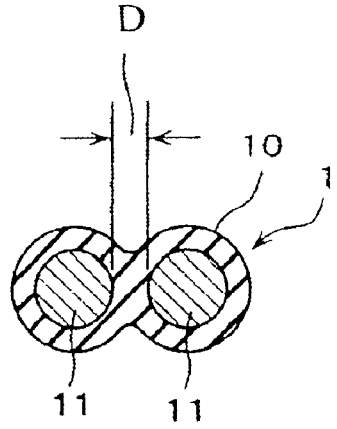
FIG. 1 is a sectional view of a coated conducting wire.

With reference to FIG. 1, reference numeral 1 denotes coated conducting wires which are manufactured by integrally coating two metallic conducting wires 11 with a non-magnetic and electrically insulating material 10. The metallic conducting wires 11 are made of a suitable material such as silver, palladium, gold, or the like. The coated conducting wires 1 may also be manufactured by coating each of the metallic conducting wires 11 with a non-magnetic and electrically insulating material 10 and thereafter by integrating or combining the coated conducting wires together by melting and adhering the electrically insulating material 10. As the non-magnetic and electrically insulating material, a material which does not diminish or disappear at the sintering temperature, such as heat-resistant glass, ceramic, or the like, is preferable. The distance D between both the metallic conducting wires 11 can be adjusted to a desired one by adjusting the coating thickness at the time of coating each of the metallic conducting wires 11 with the non-magnetic and electrically insulating material 10. In this embodiment, the distance D was set to 50 $\mu$m. Coated conducting wires 1 which were thus integrally coated by interposing the non-magnetic and electrically insulating material 10 between the two metallic conducting wires 11 were thereafter wound around a bobbin.

Figure 2:
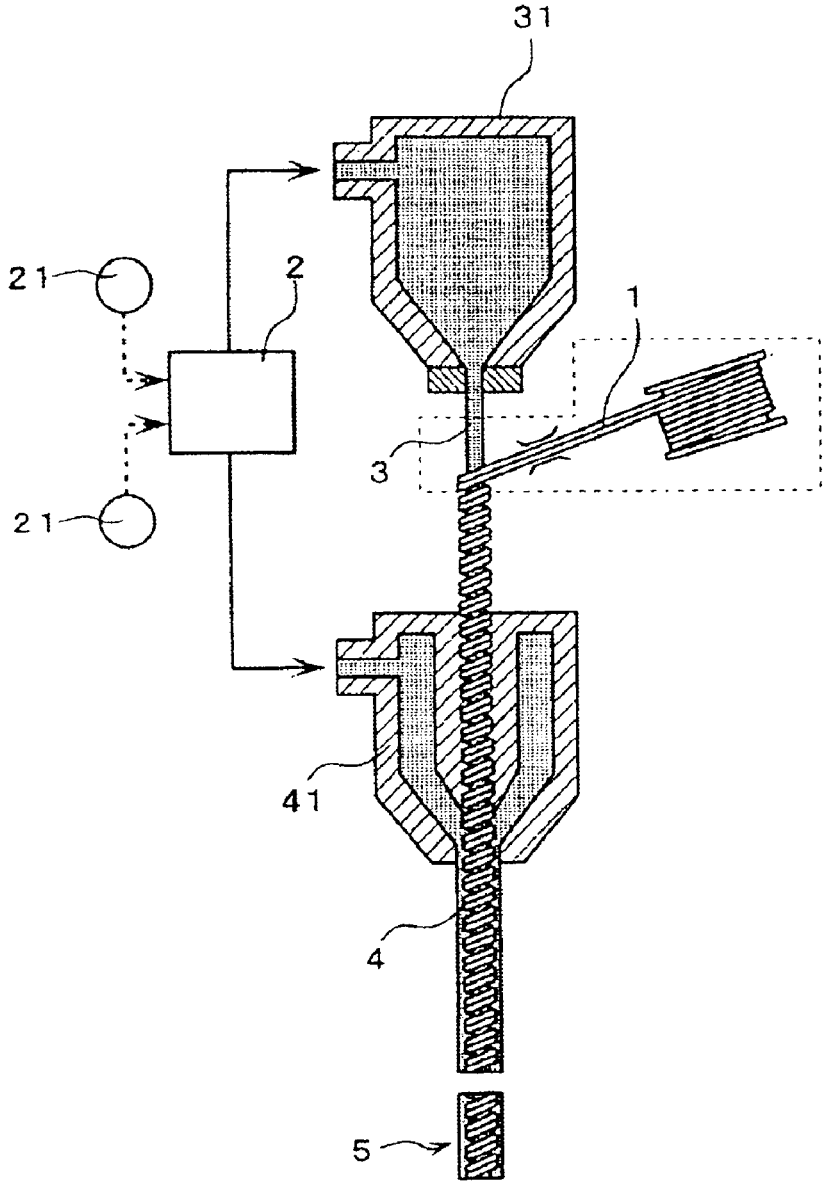
FIG. 2 is a schematic diagram showing the steps of burying the coated conducting wire.

As shown in FIG. 2, powder 21 of ferrite which is powder of a magnetic material and a binder 22 were uniformly mixed in a kneader 2. Mixed ferrite slurry was sent under pressure to a nozzle 31 by means of a screw pump (not illustrated). A columnar (or column-shaped) formed body 3 of about 1.5 mm in diameter was continuously formed out of the nozzle 31. Subsequently, the above-described coated conducting wires 1 were wound around the columnar formed body 3 at a predetermined winding pitch. The circumference or the outer surface of the formed body 3 around which were wound the coated conducting wires 1, was covered or coated by the ferrite slurry which was discharged under pressure from another nozzle 41, whereby a continuously formed body 4 was manufactured.

In order to assist the understanding of the present invention, the step of forming the core (i.e., the columnar formed body) 3 to the step of forming the continuously formed body 4 were described to be performed in a series of steps. However, the following method may also be employed. Namely, the continuously formed body 3 is first wound around a bobbin. Then, the coated conducting wires 1 are wound around the formed body 3 while rewinding or releasing the continuously formed body 3 out of the bobbin. This method is preferable because the apparatus does not become complicated and large in size.

Figure 3A:
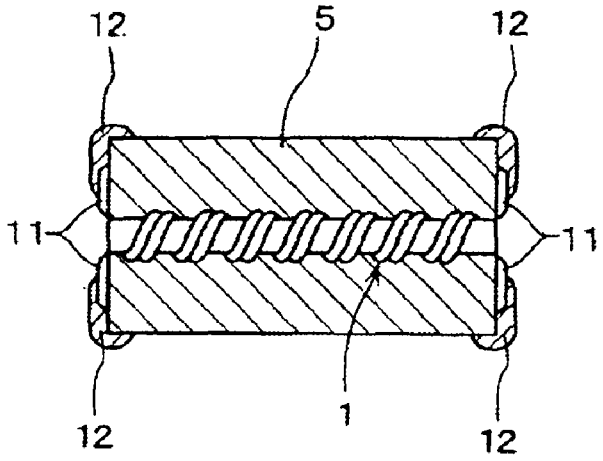
FIG. 3A is a longitudinal sectional view of a common mode choke coil.
Figure 3B:
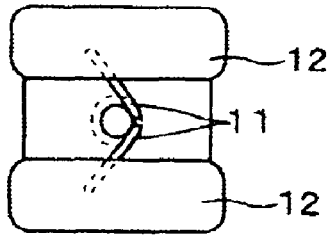
FIG. 3B is a side view thereof.

Thereafter, the continuously formed body 4 is divided by cutting it into a predetermined dimension, whereby the main bodies 5 of the common mode choke coil were formed. Inside the coated conducting wires 1 thus obtained, there are buried the coated conducting wires 1. At the same time of the above-described cutting step or after the cutting step, the magnetic material at both end portions of each main body 5 were partly removed to thereby expose the end portions of the coated conducting wires 1. Two metallic conducting wires 11 were bent in the directions opposite to each other. The semimanufactured product thus obtained were sintered in a sintering furnace. Thereafter, as shown in FIG. 3, an electrode 12 was connected to each end portion of the bent metallic conducting wires 11, whereby a common mode choke coil was manufactured.

In the above-described embodiment, the electrodes 12 were connected to the respective metallic conducting wires 11 after the sintering step. The electrodes 12 may also be formed by connecting each of them to the respective end portions of the metallic conducting wires 11 before sintering, and the semimanufactured products thus obtained may thereafter be subjected to the sintering process. Alternatively, the following method may also be employed. Namely, the continuously formed body 4 is sintered in a state of being first cut into pieces each having a length of about several tens of centimeters. After the sintering step, the semimanufactured products thus obtained are cut into a predetermined dimension to thereby obtain the main bodies 5 of the common mode choke coil. In this case, the end portions of the coated conducting wires 1 are exposed to both end portions of the main bodies 5. The metallic conducting wires 11 are separated from each other to thereby connect the electrode 12 to each of them.

Figure 4:
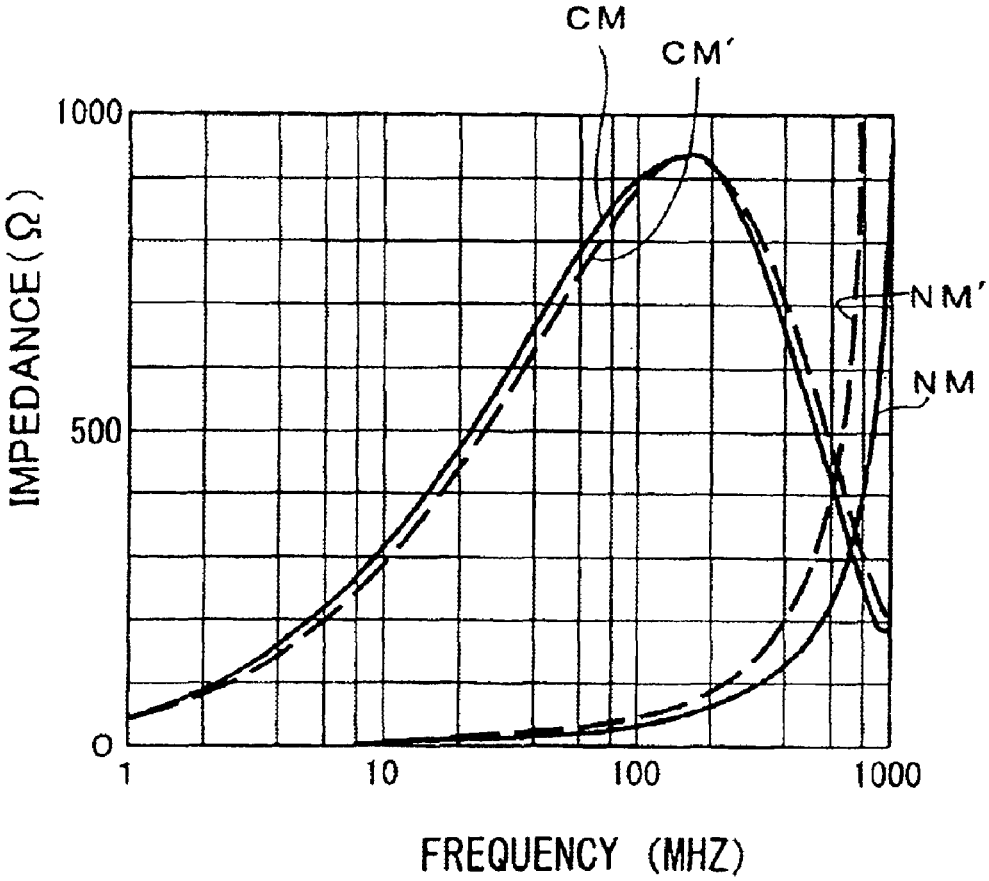
FIG. 4 is a graph showing the characteristics of common mode choke coils.

The characteristics of the common mode choke coil thus manufactured are shown in FIG. 4. The characteristics shown in FIG. 4 are those of the coil in which the coated conducting wires 1 having the distance D between the metallic conducting wires of 50$\mu$ were wound 5.5 times at a winding pitch of 300$\mu$ inside the main body 5 which is 3.2 mm×3.2 mm in cross section and 4.5 mm in length elongated in the direction of the axis of winding of the coated conducting wires 1. In FIG. 4, the reference alphabets CM denote a common mode impedance and reference alphabets NM denote a normal mode impedance. By way of comparison, the characteristics of a common mode impedance of a common mode choke coil having a distance D between the metallic conducting wires of 200$\mu$ are shown by reference alphabets of CM' and those of the normal mode impedance by NM'. As can be seen from this comparison, the following can be seen. Namely, as compared with the common mode choke coil having a larger distance D between the metallic conducting wires, in the common mode choke coil of the present invention, the capacitance or stray between both the metallic conducting wires is less likely to occur. Therefore, the normal mode impedance can be made smaller while the common mode impedance is large enough.

Figure 5:
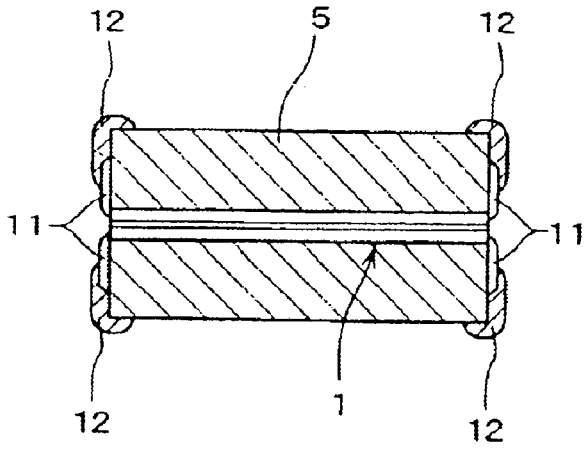
FIG. 5 is a longitudinal sectional view of a second embodiment of the common mode choke coil of the present invention.
Figure 6:
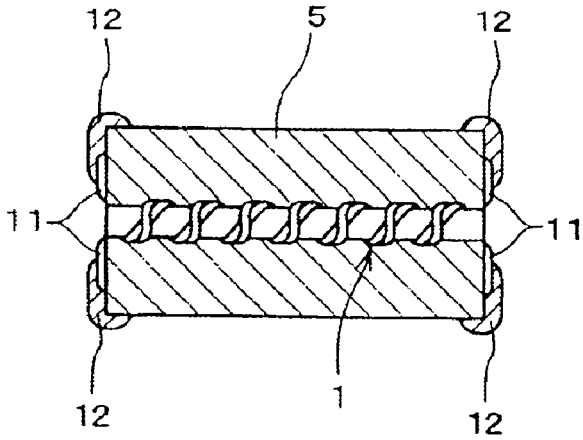
FIG. 6 is a longitudinal sectional view of a third embodiment of the common mode choke coil of the present invention.
Figure 7A:
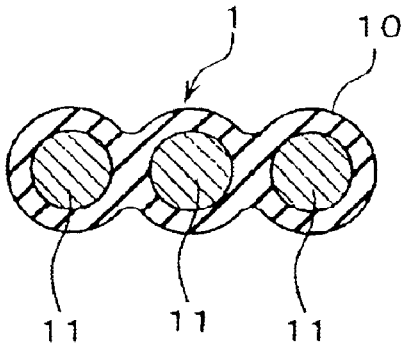
FIG. 7A is a sectional view of another embodiment of coated conducting wire.
Figure 7B:
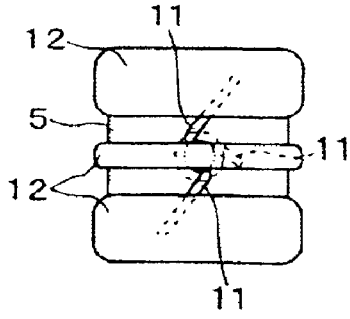
FIG. 7B is a side view of a common mode choke coil in which the coated conducting wire of FIG. 7A is used.

In the above-described embodiment, the coated conducting wires 1 were buried inside the main body 5 in a state of being spirally wound around the column-shaped formed body 3. With the common mode choke coil of a smaller inductance, however, the coated conducting wires 1 may be buried in a straight line as shown in FIG. 5, instead of in a spiral shape. Alternatively, as shown in FIG. 6, the coated conducting wires 1 may be wound around the core 3 while the coated conducting wires 1 are twisted together. In each of the above-described embodiments, there were used the coated conducting wires 1 made by integrally coating two metallic conducting wires 11 with a non-magnetic and electrically insulating material. Alternatively, as shown in FIG. 7A, there may be used coated conducting wires 1 which are manufactured by integrally coating three metallic conducting wires 11 with a non-magnetic and electrically insulating non-magnetic material. In such a case, as shown in FIG. 7B, the coated conducting wires 1 are separated into the respective metallic conducting wires 11 and are bent into three different directions. An electrode 12 is then connected to each end portion of the respective conducting wires 11.

In each of the above-described embodiments, each of the metallic conducting wires 11 used in the coated conducting wires 1 was of a single-core construction. Metallic conducting wires 11 of multiple core construction may also be used.

As can be seen from the above explanations, according to the present invention, the magnetic material will not enter into the space between the plurality of metallic conducting wires. Therefore, there can be provided a common mode choke coil and a method of manufacturing the same in which, while keeping the impedance to the normal mode noise small, the impedance to the common mode noise can be made large enough.

It is readily apparent that the above-described common mode choke coil and method of manufacturing the same meet all of the objects mentioned above and also has the advantage of wide commercial utility. It should be understood that the specific form of the invention hereinabove described is intended to be representative only, as certain modifications within the scope of these teachings will be apparent to those skilled in the art.

Accordingly, reference should be made to the following claims in determining the full scope of the invention.

What is claimed is:

1. A method of manufacturing a common mode choke coil comprising the steps of:

a) kneading powder of a magnetic material and a binder together;

b) burying coated conducting wires into a semimanufactured product obtained in step a), said coated conducting wires each having a length equivalent to at least several common mode choke coils and being integrally coated with a non-magnetic and electrically insulating material in a state in which a plurality of metallic conducting wires are spaced apart with a predetermined distance therebetween;

wherein step b) further comprises the steps of:

b1) forming a core of the semimanufactured product obtained in step a)

b2) winding said coated conducting wires around said core; and thereafter, b3) coating the semimanufactured product obtained in step b2) with the semimanufactured product obtained in step a);

c) dividing the semimanufactured product obtained in step b) into pieces, each piece having a length equivalent to one common mode choke coil;

d) exposing both end portions of each of said metallic conducting wires which constitute said coated conducting wires;

e) sintering the semimanufactured product obtained in step d); and thereafter, f) connecting an electrode to each of said end portions of each of said metallic conducting wires;

wherein said coated conducting wires are twisted together.

* * * * *